US007703817B2

(12) United States Patent
Mangone, Jr.

(10) Patent No.: US 7,703,817 B2
(45) Date of Patent: Apr. 27, 2010

(54) UNITIZED SECURITY SEAL

(76) Inventor: Peter G. Mangone, Jr., 2113 Montane Dr., Golden, CO (US) 80401

( * ) Notice: Subject to any disclaimer, the term of this patent is extended or adjusted under 35 U.S.C. 154(b) by 0 days.

(21) Appl. No.: 11/950,094

(22) Filed: Dec. 4, 2007

(65) Prior Publication Data

US 2009/0072553 A1 Mar. 19, 2009

Related U.S. Application Data

(63) Continuation-in-part of application No. 11/717,376, filed on Mar. 12, 2007, now Pat. No. 7,559,587.

(51) Int. Cl.
*B65D 27/30* (2006.01)
*B65D 33/34* (2006.01)

(52) U.S. Cl. ..... 292/307 R; 292/315; 292/316; 292/317; 292/320; 24/16 PB; 24/17 A; 24/17 PB

(58) Field of Classification Search ..... 292/307 R, 292/315–326; 24/16 PB, 17 A, 17 PB
See application file for complete search history.

(56) References Cited

U.S. PATENT DOCUMENTS 2,314,814 A * 3/1943 Borland ..... 292/315
3,311,957 A * 4/1967 Dunn ..... 24/21
3,466,077 A 9/1969 Moberg
3,712,655 A 1/1973 Fuehrer
3,954,295 A 5/1976 Harley
4,059,300 A 11/1977 Moberg et al.
4,214,349 A 7/1980 Munch
4,229,031 A 10/1980 Guiler
4,240,183 A 12/1980 Sumimoto et al.
4,263,697 A 4/1981 Speedie
4,319,776 A 3/1982 Moberg
4,501,049 A * 2/1985 Adamson ..... 24/30.5 P
4,559,676 A 12/1985 Paradis
4,588,218 A 5/1986 Guiler et al.
4,609,218 A 9/1986 Chevillard et al.
4,854,014 A * 8/1989 Ueno ..... 24/16 PB
4,946,210 A 8/1990 Fuehrer
5,056,837 A 10/1991 Fuehrer
5,183,301 A * 2/1993 Lundberg, Jr. ..... 292/318

(Continued)

FOREIGN PATENT DOCUMENTS

GB 2205279 A * 12/1988

OTHER PUBLICATIONS

U.S. Appl. No. 11/717,376, filed Mar. 12, 2007, Mangone.

*Primary Examiner*—Carlos Lugo
(74) *Attorney, Agent, or Firm*—Drinker Biddle & Reath LLP

(57) ABSTRACT

A unitized security seal having a shackle, an engagement housing with a passage for receiving the shackle, and at least two locking members spaced along the shackle with undercut openings to the outer surface of the locking members, at least one pin being located within the housing passage and oriented to engage the undercuts as the shackle is advanced through the passage to provide non-removable engagement of the shackle in the housing, and at lease one undercut including a frangible member positioned between its entry and its exit for engaging an engagement housing pin to resist removal of the shackle from the engagement housing until a sufficient force is applied to shear away the frangible member.

24 Claims, 17 Drawing Sheets

U.S. PATENT DOCUMENTS

D355,054 S * 1/1995 Self ..... D29/129
5,568,952 A 10/1996 Ruegg
6,174,006 B1 * 1/2001 Burt ..... 292/307 A
6,347,434 B1 2/2002 Newman
6,449,808 B1 9/2002 Zappa et al.

* cited by examiner

UNITIZED SECURITY SEAL

CROSS-REFERENCE TO RELATED PATENT APPLICATIONS

This application is a continuation-in-part of U.S. patent application Ser. No. 11/717,376, filed Mar. 12, 2007. The entire disclosure of the foregoing patent application is hereby incorporated by reference.

FIELD OF THE INVENTION

This invention relates to security seals and, more particularly, to unitized or integrally formed security seals that can be efficiently molded with frangible members and access-limiting features that enhance the security attributes of the seals.

BACKGROUND OF THE INVENTION

There is a substantial need for security seals that may be manufactured efficiently and economically, and that are easy to use. Many seals are currently available including seals formed of molded plastic in which a hollow body is formed as a single unit with internal flexible fingers for engaging a shackle.

Unfortunately, in order to efficiently mold plastic security seals of this type, the conventional wisdom is that the housing must be open at both ends to enable molding in a single step without the use of collapsible core molding tool members. However, an open housing typically makes it easy to pass a pick or other tool into the housing to disengage the locking fingers that retain the shackle, thereby circumventing the security function of the device.

Various approaches to overcome the shortcomings of molded plastic security seals have been suggested over the years. None are without drawbacks. An early approach suggested in the prior art is illustrated in FIG. 1A. In this design, a closed locking housing 2 is formed with resilient locking members 3 that engage a pin 4. This design is extremely difficult (if not impossible) to manufacture and requires a complex collapsible core molding system which, if implemented on the very small scale typical of many conventional security seals, would be expected to be difficult to operate, to be liable to produce many mis-molded products, and to be subject to substantial manufacturing downtime.

Another example of a prior art design, as illustrated in FIG. 1B, includes an enclosed housing 7 with a separate locking member 6 mounted in the enclosed housing to block the bore of the locking member. Enclosed housing 7 includes an optional metallic cylinder 5 press-fitted into the housing to make it difficult to cut away the rear end of the housing to gain access to the interior of the housing to release the seal. Unfortunately, this design is complicated and expensive to manufacture and assemble. Also, its security function can be compromised by prying member 6 away from housing 5 and receptacle 7 and releasing the shackle, and re-assembling later without any indication that the seal was disturbed.

Yet another prior art approach is illustrated in FIG. 1C. The security seal shown in this figure includes an open bore locking member 8 with one end of the bore closed off by a separate cover 9. Again, this approach is complex, expensive to make and assemble, and can be compromised and re-assembled.

Accordingly, it is an object of the present invention to provide a security seal with a design that can be molded as a unitized device without the use of complex collapsible core mold elements.

It is a further object of the present invention to provide a security seal that is economical to make and easy to operate.

It is another object of the present invention to provide a security seal in which the security function is particularly difficult to circumvent.

Another object of the present invention is to provide a security seal that achieves an engagement that cannot be compromised without either destroying the device or providing an indication that it has been compromised.

Yet another objective of the present invention is to provide a security seal with a locking mechanism having one or more frangible members that will shear away or break if the locking mechanism is breached to help prevent fraudulent reuse of the security seal.

A still further objective of the present invention is to provide a security seal with access-limiting members to thwart tampering.

These and other objects and advantages may be achieved in accordance with the present invention as described below.

BRIEF SUMMARY OF THE INVENTION

The present invention is a unitized security seal that may be molded in a single stage without the use of collapsible mold core components. It includes a shackle, an engagement housing with a bore or passage for receiving the shackle and one or more frangible members that will shear away or break if the locking mechanism of the security seal is breached.

Preferably, the shackle has at least two locking members spaced along it, although it may have a single locking member. Each locking member has at least one undercut extending from the outer surface of the locking member to an undercut floor, with the undercut having an entry and an exit at opposite ends of the undercut along the longitudinal axis of the shackle. The locking members preferably will have pairs of diametrically opposed undercuts and the undercut openings of adjacent locking members will be offset from each other.

An engagement housing is located adjacent the proximal end of the shackle. It has a passage or bore for receiving the shackle and at least one pin located within the passage oriented to extend into the undercut when a locking member on the shackle is passed through the passage. In a preferred embodiment, where the locking members have pairs of diametrically opposed undercuts, at least two diametrically opposed pins will be located in the engagement housing passage to engage the opposing undercuts when the locking member on the shackle is passed through the passage.

In one embodiment of the invention, an undercut includes a frangible member positioned between its entry and its exit for engaging an engagement housing pin to resist removal of the shackle from the engagement housing until a sufficient force is applied to shear away the frangible member. In a preferred embodiment, the frangible member is an upstanding wall projecting away from the floor of the undercut. In a yet further preferred embodiment, the upstanding wall ramps down from the entry of the undercut at an angle of about 10° to 20° to the longitudinal axis of the shackle to form a narrowed passage at the exit of the undercut. Still more preferably, the upstanding wall ramps down from the entry of the undercut at an angle of about 15° to the longitudinal axis of the shackle.

A domed plug may be located at the distal end of the shackle dimensioned to limit illicit access to the engagement housing passage. The plug will include an engagement slot with a floor that extends across the plug generally in alignment with the longitudinal axis of the shackle to permit the plug to move past the engagement housing pin as the shackle passes through the passage in the housing. The floors of the locking member undercuts and the engagement slot of the plug preferably will be in communication with each other to permit the shackle to slide and resile as it passes through the passage to its locked configuration.

In yet another embodiment of the invention, the unitized security seal includes an arrow member having wings projecting beyond the outer profile of the distal locking member. The arrow member is joined to the distal end of the shackle by a frangible link. The wings having sufficient resiliency to permit them to be compressed inwardly to enter and through the engagement housing passage and to return generally to their original shape when they emerge from the housing passage. The wings thus engage the top edge of the engagement housing to resist removal of the shackle from the engagement housing. Forcing the closed shackle from the housing will shear away the frangible link and the arrow member providing an indication that the security seal has been breached.

BRIEF DESCRIPTION OF THE DRAWINGS

The features of this invention that are believed to be novel are set forth with particularity in the appended claims. The invention, together with its objects and advantages, may be best understood by reference to the following description, taken in conjunction with the following drawings, in which like reference numerals identify like elements in the several figures, and in which:

DETAILED DESCRIPTION OF SELECTED EMBODIMENTS OF THE INVENTION

Figure 1A:
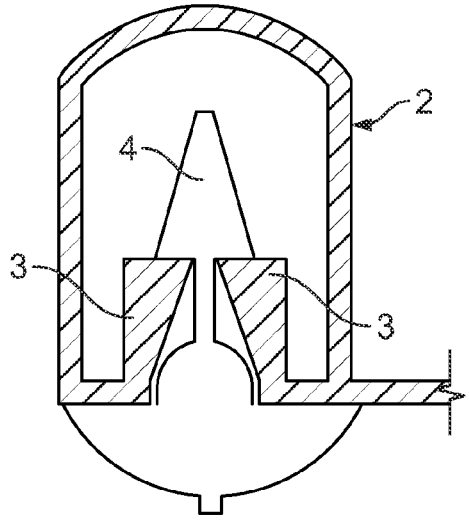
FIG. 1A (Prior Art)
FIGS. 1A-1C are views of prior art security seals.
Figure 1B:
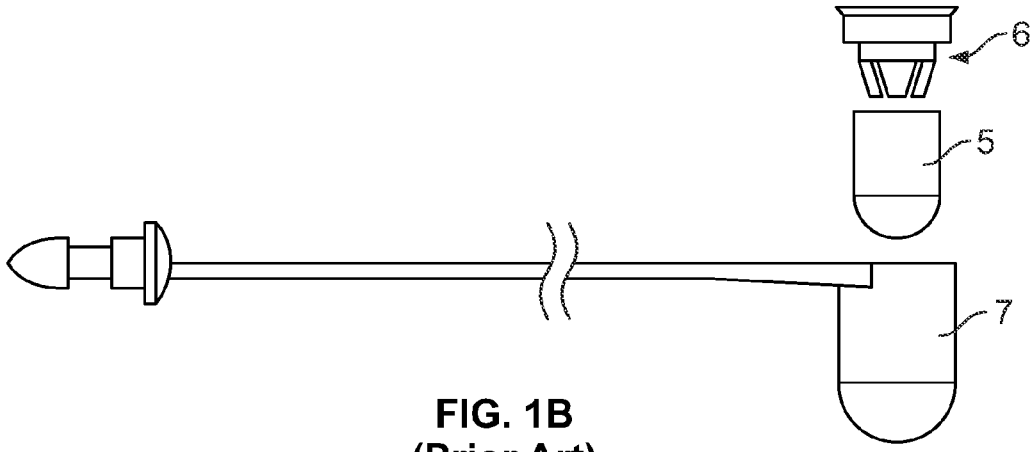
FIG. 1B (Prior Art)
Figure 1C:
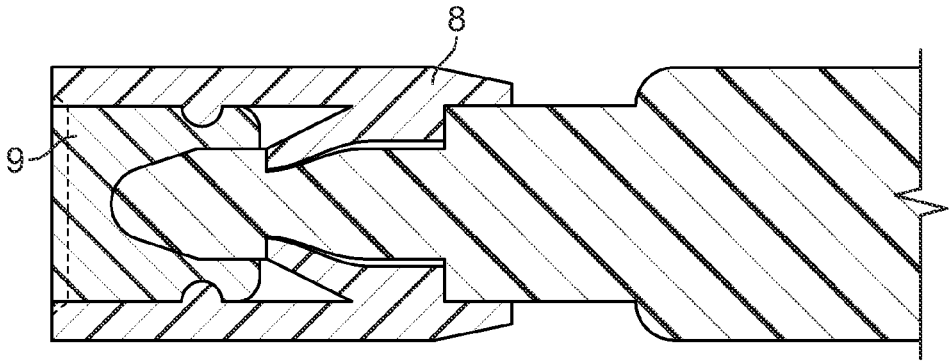
FIG. 1C (Prior Art)
Figure 2A:
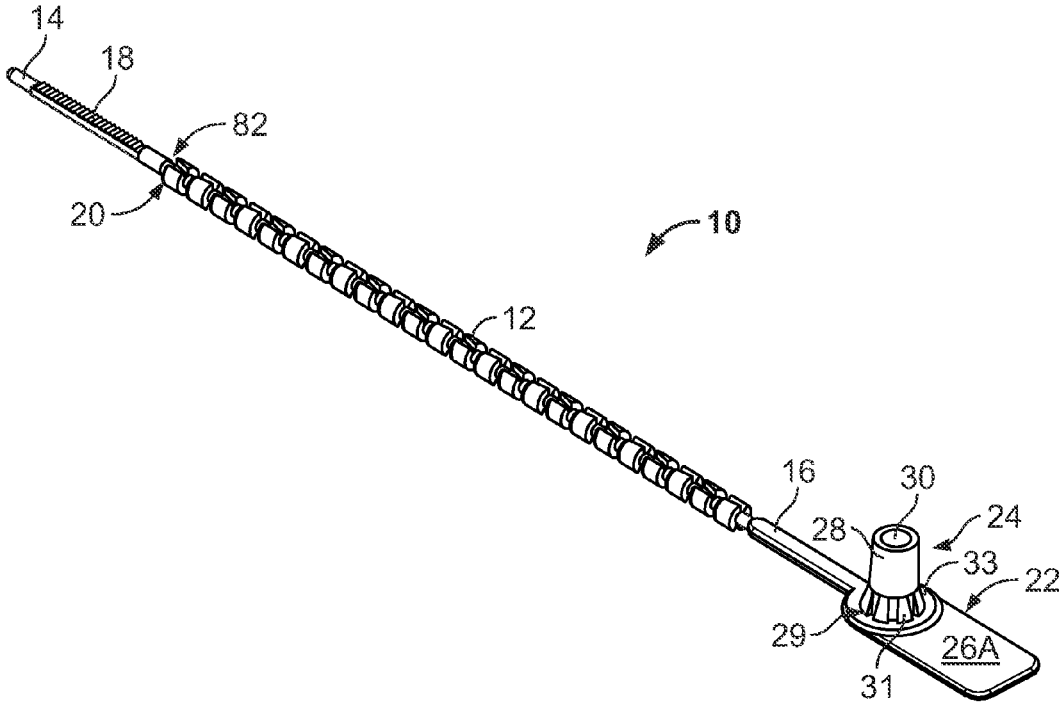
FIGS. 2A and 2B are perspective views of an elongated security seal in accordance with this present invention.
Figure 2B:
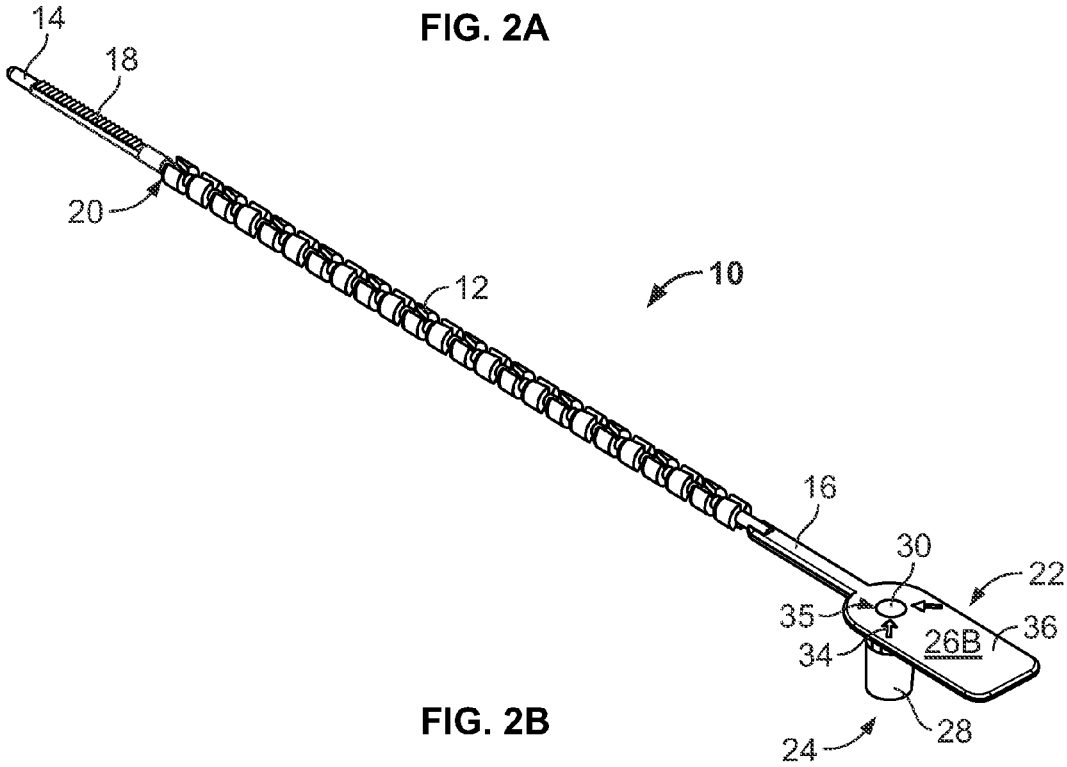

Turning now to FIGS. 2A and 2B, a unitized security seal 10 in accordance with the present invention is illustrated in two views rotated with respect to each other 180 degrees about the longitudinal axis of the device. Unitized security seal 10 may be molded of polypropylene, polyethylene, nylon or other appropriate resilient resin in a single stage and without the use of collapsible mold core components. The security seal includes a shackle 12 having a handle 14 at its distal end and a shackle base 16 at its proximal end. Handle 14 preferably includes serrations 18 to facilitate gripping. The shackle may be any desired length; for example, it may be 18 inches, 14 inches, 10 inches or shorter in length. The material and dimensions of the shackle (and the rest of the device) will be chosen to ensure that the shackle has sufficient flexibility to be bent around to the engagement housing of the device which is described below.

Shackle base 16 carries a security seal platform 22 at its proximal end that includes an upstanding engagement housing 24. Platform 22 is enlarged in the illustrated embodiment to present flat "flag" surfaces 26A and 26B appropriate for labeling and/or serializing the security seal as desired.

Engagement housing 24 includes a conical member 28 extending generally perpendicularly to the longitudinal axis of shackle 12 when it is in its unlocked and unbent configuration as shown in FIGS. 2A and 2B. Conical member 28 has a central passage in the form of bore 30 extending through it. The base 29 of the conical member is flared outwardly in the illustrated embodiment into a series of triangular brace members 31 to enhance the strength and ensure the integrity of the engagement housing. The brace members rest on an optional circular pedestal 33 which is formed in platform 22.

Arrows 34 are molded onto the back 36 of platform 22 to direct the user to insert handle 14 and shackle 12 into the entry 35 of bore 30 as required to achieve a proper irreversible locking of the shackle within the engagement housing. The irreversible locking feature of the shackle will be explained in more detail below.

Figure 3:
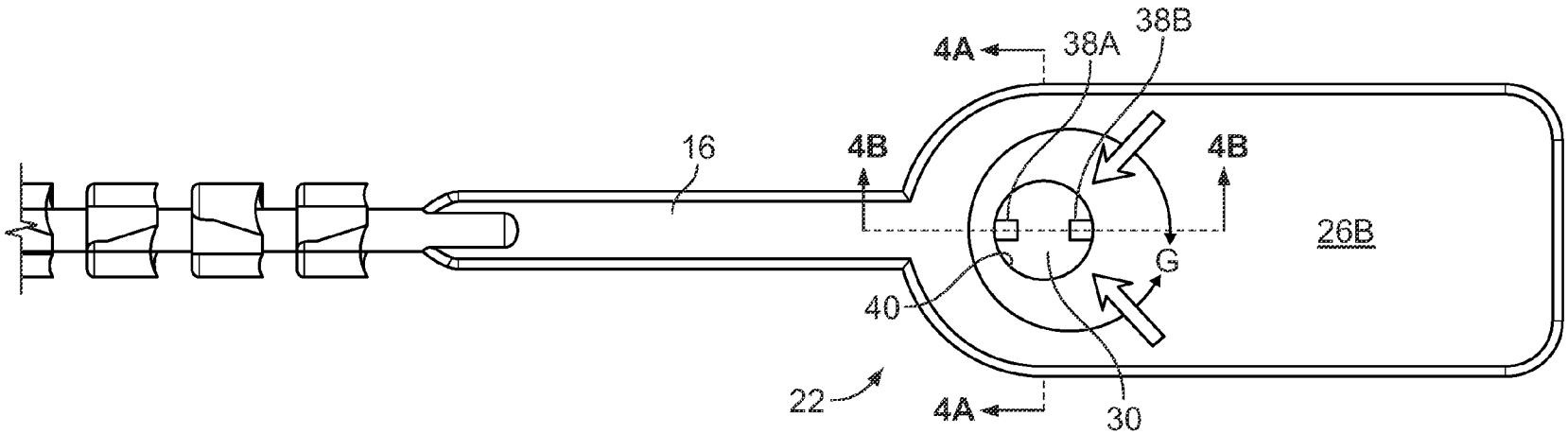
FIG. 3 is an elevation view of a proximal portion of the security seal of FIGS. 2A and 2B.
Figure 4A:
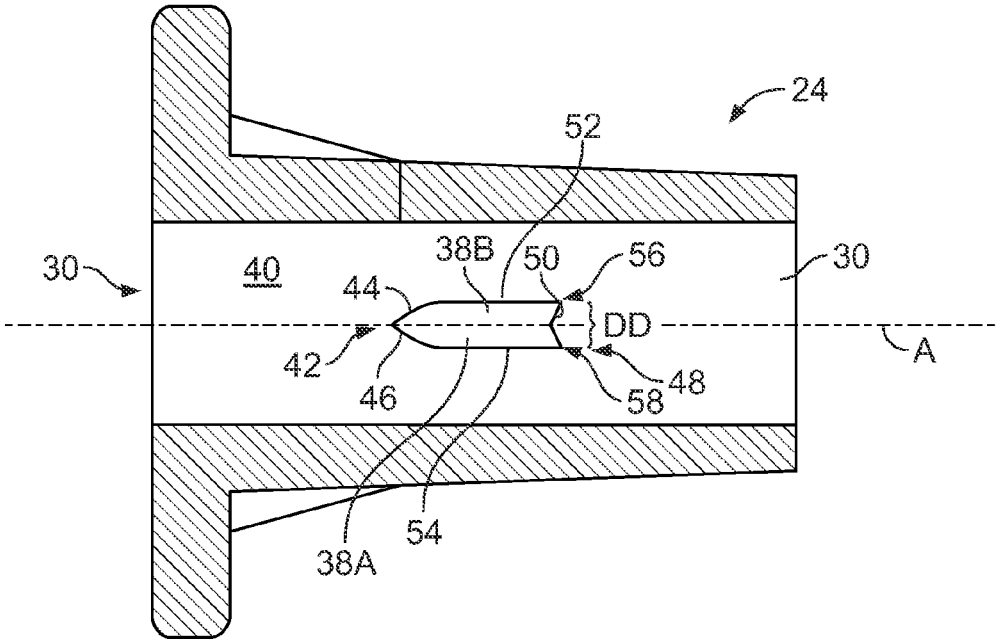
FIG. 4A is an enlarged cross-sectional view of the shackle-receiving engagement housing of the security seal of FIG. 3, taken along lines 4A-4A of FIG. 3.
Figure 4B:
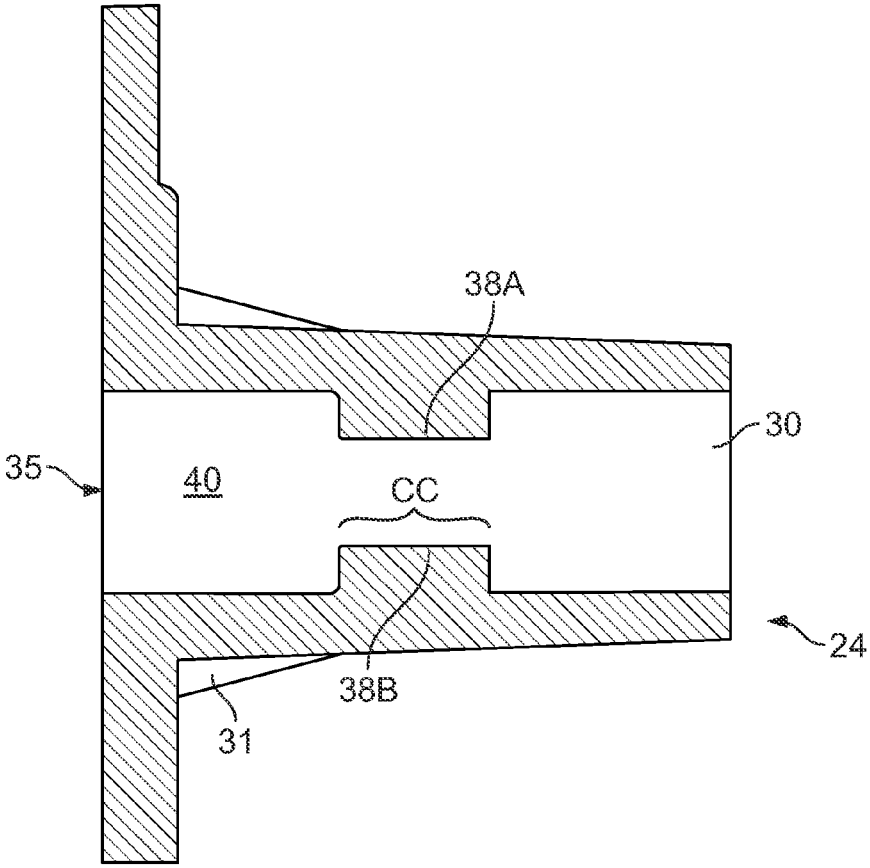
FIG. 4B is an enlarged cross-sectional view of the shackle-receiving engagement housing of the security seal of FIG. 3, taken along lines 4B-4B of FIG. 3.

FIG. 3 is an enlarged elevation view of a portion of the proximal end of the security seal of FIGS. 2A and 2B in which diametrically opposed pins 38A and 38B may be seen within bore 30. The longitudinal axis A of the pins (FIG. 4A) is generally parallel to the axis of the bore. (While two pins are preferred as illustrated, a single pin could be used.) In the cross-sectional views of engagement housing 24 of FIGS. 4A and 4B, it is seen that pin 38B is molded onto the wall 40 of bore 30 and extends into the bore. Pins 38A and 38B are generally identical, and each includes a tapered nose portion 42 having generally flat angled sides 44 and 46. In the illustrated embodiment, these sides are at an angle of about 30° to the longitudinal axis A of the pin, although they may be of any suitable angle and preferably will be at an angle in the range of about 25 to 40 degrees to the axis. The pins have a length CC and a width DD.

Each of pins 38A and 38B also includes a pin base portion 48. The base portion has an indentation 50 that extends to the outer edges 52 and 54 of the pins to produce rearwardly directed projections 56 and 58 at either edge of the base portion of the pins.

Figure 5:
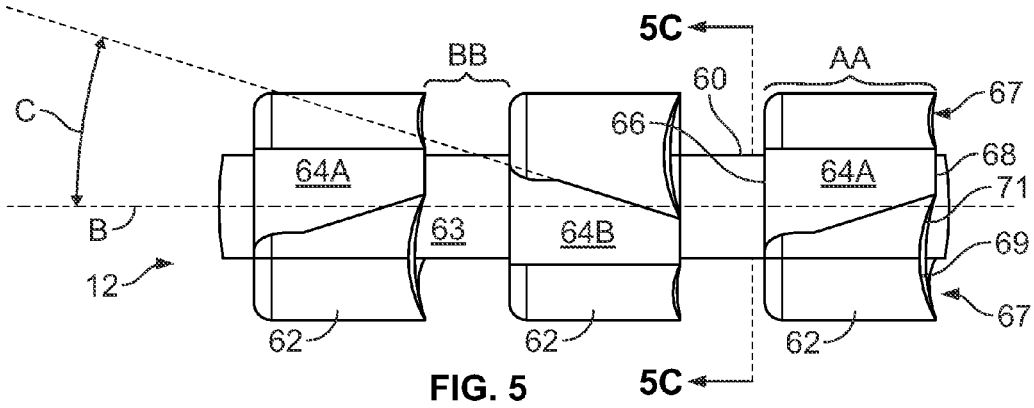
FIG. 5 is an enlarged elevation view of a portion of the shackle of the security seal of FIGS. 2A and 2B showing three annular locking elements.

FIG. 5 is an enlarged elevation view of a portion of shackle 12 of the security seal of FIGS. 2A and 2B. As can be seen here, the shackle includes a central member 60 that carries a series of spaced integral annular locking members 62. Central member 60 in the illustrated embodiment has opposite generally flat faces 63 and 65 (FIG. 5C) and is thin enough to ensure that the central member will break before sufficient force can be transmitted to the shackle to overcome the engagement of the shackle in the engagement housing. Such a break anywhere in the central member of the shackle will signal that the security seal was breached and will prevent surreptitious reuse of the device. Center member 60 may, however, be of circular or other cross-sectional shape, as desired.

In its straight configuration as shown in FIG. 5 (before the shackle is bent around to be locked into the engagement housing), the central longitudinal axis of the central member is generally straight as represented by line "B". The locking members each have a length "AA" and they are spaced longitudinally from each other along the central member a distance "BB". Rotation of the shackle to move generally trapezoidal undercuts 64A and 64B (FIGS. 5A & 5B) in locking members 62 into alignment with the pins will be resisted by the upwardly ramping sides 71 of scallops 67 that will be encountered by projections 56 and 58 at the base of the pins, as explained below.

Certain relationships between the length AA of the locking members, the spacing BB between the locking members and the length CC of the pins should be maintained in the security seal, as follows:

$$BB<CC$$

$$AA+BB>CC$$

Maintaining these relationships helps ensure that when the shackle is in position in the engagement housing the pin remains engaged with the generally trapezoidal undercuts and the shackle cannot be moved into a position in which the pin would be free within the space BB between adjacent locking members.

Locking members 62 each have generally trapezoidal-shaped undercuts 64A or 64B extending radially upward from flat faces 63 and 65 of the central member and running from the distal edge 66 to the proximal edge 68 of each annular locking member. The generally trapezoidal undercuts have an exit opening 73 coextensive with proximal edge 68 and an entry opening 75 coextensive with distal edge 66. Openings 73 and 75 are substantially parallel and opening 75 is larger than opening 73. Pins 38A and 38B thus enter through opening 75 and are "funneled" through the generally trapezoidal undercuts and opening 73 as the shackle is moved into engagement with engagement member 24. Exit opening 73 has a width EE. It is preferred that the width DD of pins 38A and 38B be substantially equal to the width EE of the exit opening to minimize the likelihood that the engagement member could be worked loose from the pins. "Substantially equal" in this context means that the width of the exit opening is of a size with respect to the width of the pin that will permit the pin to pass through the exit opening while engaging both sides of the opening and without preventing the shackle from being advanced through the engagement housing.

Figure 5A:
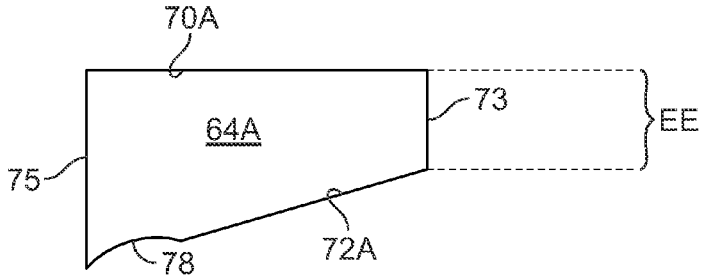
FIGS. 5A and 5B are diagrammatic representations of generally trapezoidal undercuts in annular locking members of the security seal.
Figure 5B:
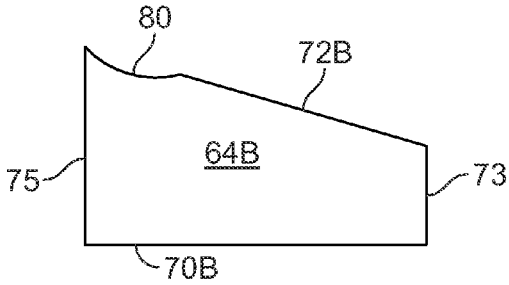
Figure 5C:
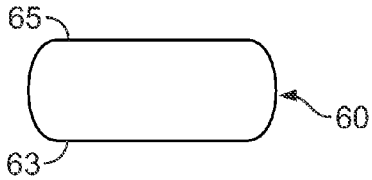
FIG. 5C is a cross-sectional view of the central member of the shackle of the security seal taken along lines 5C-5C of FIG. 5.

The generally trapezoidal-shaped undercuts 64A and 64B are illustrated diagrammatically in FIGS. 5A and 5B. Thus, as seen in these figures, undercuts 64A have an inner wall 70A that is generally parallel to longitudinal axis B of the unbent shackle central member 60 and an outer ramp wall 72A that is angled to longitudinal axis B. In the illustrated embodiment, the angle "C" of the ramp wall is about 15° to longitudinal axis B. While an angle of approximately this size is most preferred, the angle may preferably range from about 10 to 20 degrees. Undercut 64B is generally a mirror image of undercut 64A so that the inner wall 70B of undercut 64B is generally parallel to longitudinal axis B and outer ramp wall 72B is at an angle generally corresponding to that of inner wall 72A. The proximal edges of the annular locking members each have scallops 67 as shown in FIG. 5. Ramp walls 72A and 72B may also include optional bosses 78 and 80 that project into the generally trapezoidal undercut area adjacent to the entry openings to help guide the pins into the undercut area and to resist removal of the shackle from the engagement member by backing the pin out of the generally trapezoidal undercut.

The inner and ramp walls of the generally trapezoidal undercuts meet scallops 67 at or near their respective high points. Therefore, as explained in more detail below, when the projections at the base of pins 38A or 38B abut the bottom 69 of the scallops, rotation of the shackle to position the pins into alignment with the generally trapezoidal undercuts is resisted by the upwardly ramping sides 71 of the scallops.

Figure 6C:
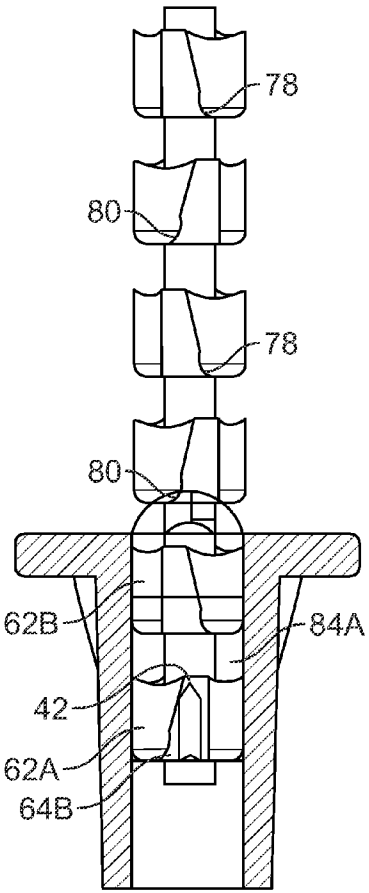
FIGS. 6A-6F are partial views of the security seal of FIGS. 2A and 2B showing its shackle advancing within the shackle-receiving engagement housing of the security seal to lock the shackle to the engagement housing and resist pull-out.
Figure 6B:
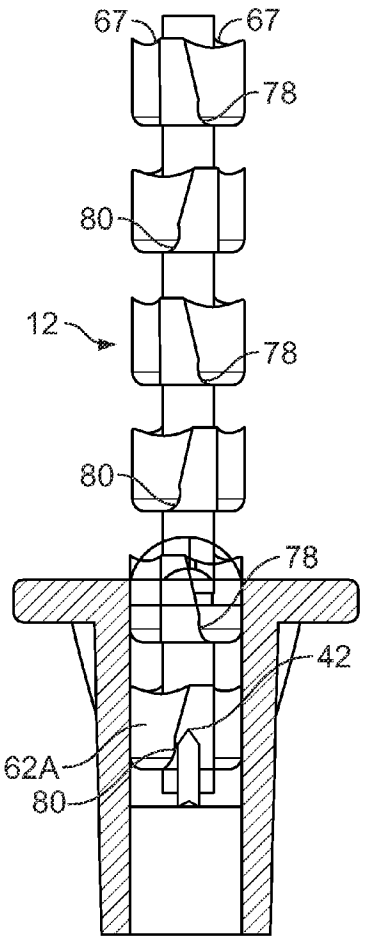
Figure 6A:
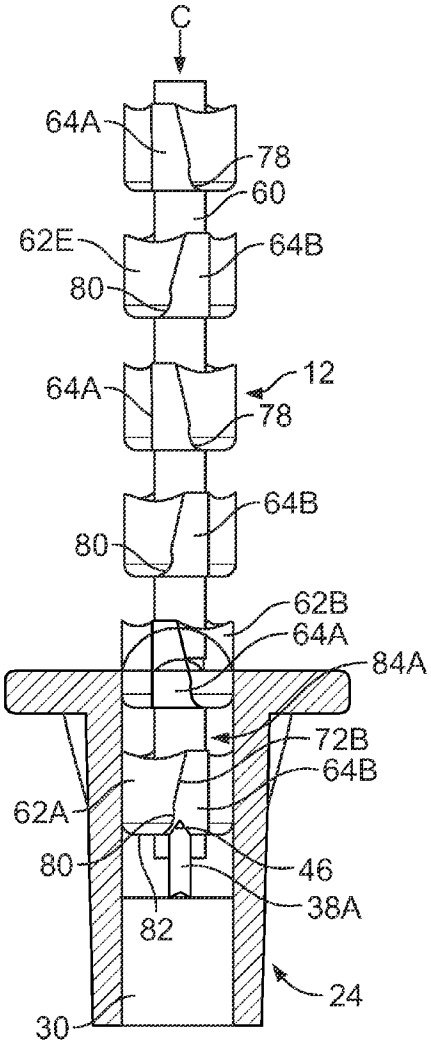

We turn now to FIGS. 6A-6F to illustrate the irreversible locking function achieved when shackle 12 is inserted in direction "C" into entry 35 of engagement housing 24. Thus a portion of the distal end 82 of the shackle is shown in FIG. 6A with outer ramp wall 72B of generally trapezoidal undercut 64B of the first annular locking member 62A engaging side 46 of pin 38A. As the distal end of the shackle member is moved further into bore 30 of the engagement housing, the pin rides along ramp wall 72B and the advancing shackle member resiles or rotates counterclockwise under the urging of the advancing ramp wall against the pin (FIG. 6B). Pin 38A may flex slightly under the force applied by the ramp wall but will resile back to its original position as the shackle moves past the pin. When the shackle reaches the position shown in FIG. 6C, nose portion 42 of pin 38 has begun to emerge from generally trapezoidal undercut 64B of the annular locking member 62A as it enters the space 84A between the first annular locking member 62A and the second annular locking member 62B.

Figure 6F:
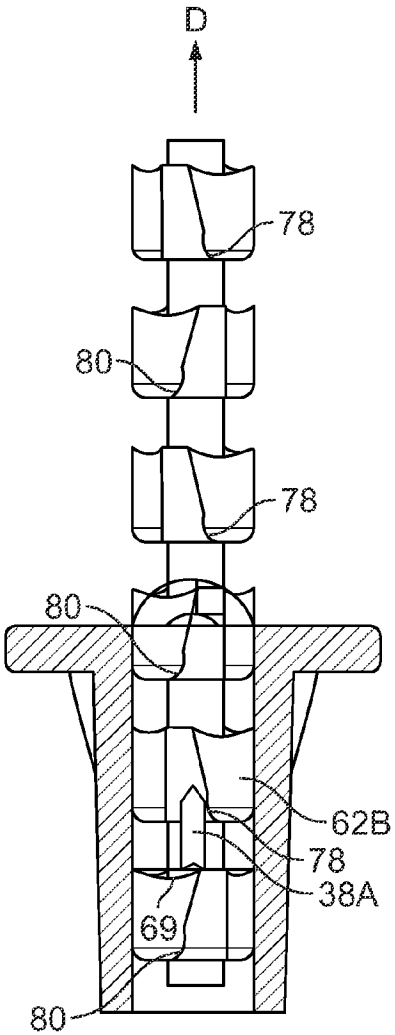
Figure 6E:
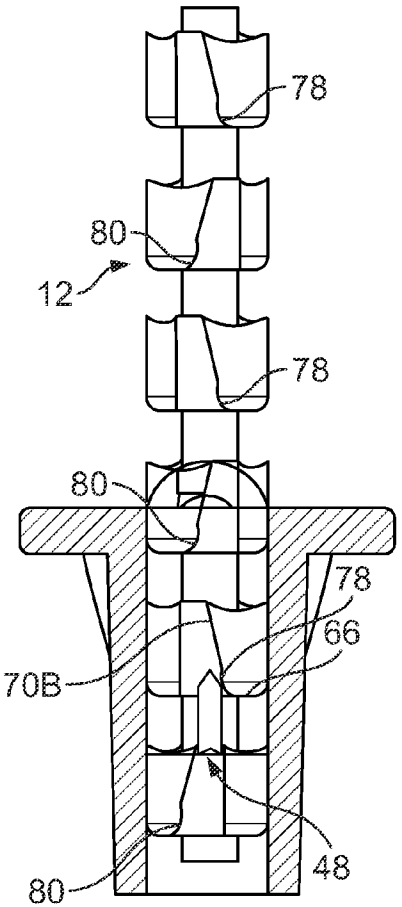
Figure 6D:
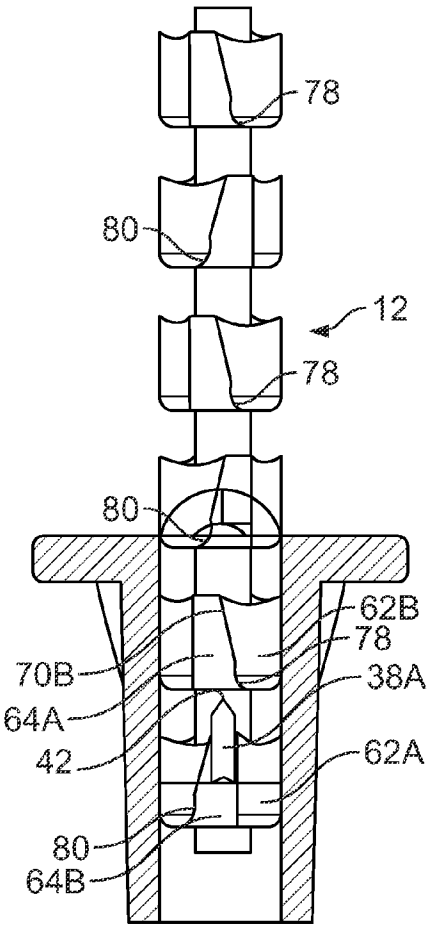
Figure 7:
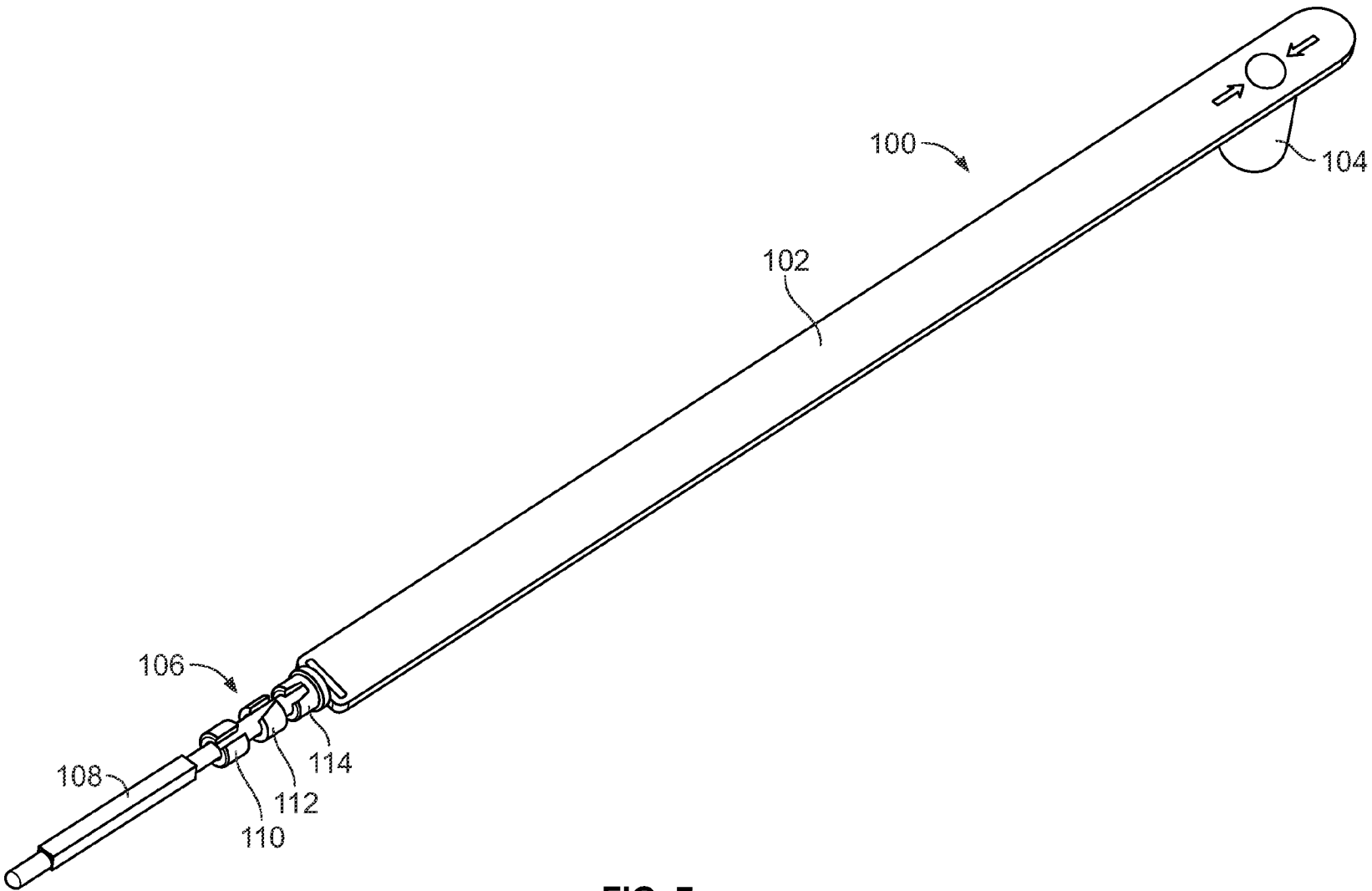
FIG. 7 is a perspective view of an alternative embodiment of the invention having a flexible elongated strap between the shackle and the shackle-receiving engagement housing.

In FIG. 6E shackle 12 is shown advanced to the point where generally trapezoidal undercut 64A of annular locking ring 62B meets nose portion 42 of pin 38A, as generally trapezoidal undercut 64B of the most distal locking ring 62A of the shackle disengages from the pin. In FIG. 6E, the continuing advancement of the shackle causes contact surface 70B to move along the pin causing the shackle to resile back and to rotate clockwise under the urging of the pin against ramp wall 70B. This continues until the base portion 48 of the pin clears the distal wall 68 of the first locking ring, as shown in FIG. 6F. In this position, the projections 56 and 58 (FIG. 4A) at the base of pins 38A or 38B abut the bottom 69 of the scallops. As a result, any attempt to remove the shackle from engagement housing 24 (by moving it in direction "D") will be blocked by the offset of the generally trapezoidal undercuts of adjacent locking members. Additionally, any attempt to pass a pick or other member longitudinally into bore 30 to get at the pin and rotate the shackle in order to back it out of the locking housing will be blocked by the offset of oppositely oriented generally trapezoidal undercuts 64A and 64B. Furthermore, the same result obtains for attempts made at either the proximal or the distal end of the bore. As the shackle advances further into the locking housing, it will rotate alternatively clockwise and counterclockwise as described above. Attempts to remove the shackle will become more and more difficult after more locking members have been moved past the pins since the presence of more locking members will make it more cumbersome to defeat the locking mechanism for each successive locking member within and proximal to bore hole 30. This resistance to removal of the shackle is enhanced by bosses 78 and 80 which help impede distal movement of the ramp walls past the pins.

FIGS. 7-10 illustrate an alternative embodiment of the invention in which a security seal 100 is provided with a generally flat strap 102 located between an engagement housing 104 (configured as described above with respect to features 22 and 24 of security seal 10) and a shortened shackle portion 106 having a handle 108 at its distal end. In the illustrated embodiment, shackle portion 106 includes three annular locking members 110 and 112 and 114.

Figure 8:
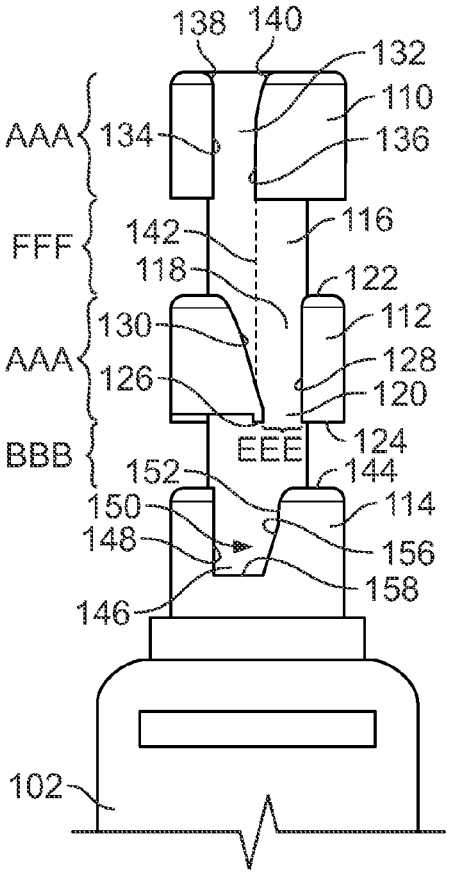
FIG. 8 is an enlarged partial elevation view of the distal end of the security seal of FIG. 7 with the handle of the seal removed.

The distal end of shackle portion 106 (with the handle of the seal removed for illustration purposes) is illustrated in FIG. 8. As can be seen in this figure, the shackle includes a central member 116 that is generally circular in cross-section. As is apparent in this figure, locking members 110, 112 and 114 each have different configurations but the same lengths "AAA". Beginning with intermediate annular member 112, it is seen that this locking member has a generally trapezoidal-shaped undercut 118 extending radially upward from the surface 120 of central member 116. This generally trapezoidal undercut extends from the distal face 122 to the proximal face 124 of annular locking member 112. Proximal face 124 is generally flat, but includes a proximally directed spur 126. The generally trapezoidal undercut includes an inner wall 128 generally parallel to the longitudinal axis of the shackle and an outer ramp wall 130. The angle of the ramp wall with respect to the axis of the shackle is about 15°, and preferably will range from about 10 to 20 degrees.

The most distal annular locking member 110 ("the entry locking member") serves to guide the shackle over the locking pins of the engagement housing and to block entry to bore 160 of engagement housing 104 when the shackle is fully engaged. The entry locking member includes a generally straight undercut 132 having an outer sidewall 134 and an inner sidewall 136. The most proximal ends of the walls of the generally straight undercut are radiused at 138 and 140 to facilitate entry of pins 162A or 162B into the undercut, as will be explained below. Also, undercut 132 is offset with respect to undercut 118, to prevent a clear line of sight between the undercuts and hence entry of a pick or other tool intended to overcome the security of a shackle engaged in the engagement housing. This is illustrated, for example, by broken line 142 which extends proximally from inner sidewall 136 in annular locking member 110 and intersects outer ramp wall 130 of annular locking member 112.

Finally, shackle 106 includes a proximal annular locking member 114 attached to strap 102. Annular locking member 114 has a distal face 144 and a generally trapezoidal undercut 146 extending radially upward from surface 120 of central member 116. Undercut 146 includes a generally flat outer wall 148 and an inner wall 150 having a radiused entry point 152, and an inwardly ramped base wall 156. Undercut 146 is closed at its base 158. The spacing between locking members 110 and 112 is designated FFF and the spacing between locking members 112 and 114 is designated BBB.

Figure 9:
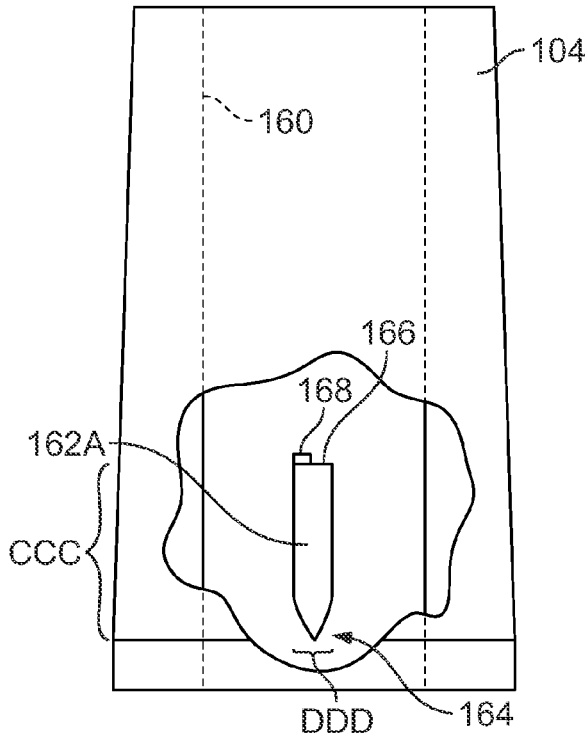
FIG. 9 is a cutaway elevation view of the shackle-receiving engagement housing of the security seal of FIG. 7.

In FIG. 9, engagement housing 104 is shown with its bore or passage 160 in broken lines. A portion of the engagement housing has been cut away in this figure to reveal pin 162A in the housing (pin 162B has been removed to improve the clarity of the view). Pin 162A includes a tapered nose 164 generally corresponding to tapered nose 42 of pins 38A and 38B. Base 166 of pin 162A includes a rearwardly projecting pin spur 168 generally corresponding to spur 126 of annular locking member 112. The pin has a length CCC and a width DDD. As in the case of the embodiment of the invention of FIGS. 1-7, the length CCC of the pin must be greater than the space BBB between annular members 112 and 114 and it is preferred that the width DDD of the pin is substantially equal to the exit opening EEE of generally trapezoidal undercut 118 to minimize the likelihood that engagement member 104 could be worked loose. However, it should be noted that in the illustrated embodiment spacing FFF between annular members 110 and 112 is greater than spacing BBB between annular members 112 and 114 because the critical locking function is achieved in this embodiment through the offset of the generally trapezoidal openings of annular members 112 and 114 and by the engagement of spurs 126 and 168.

Figure 10:
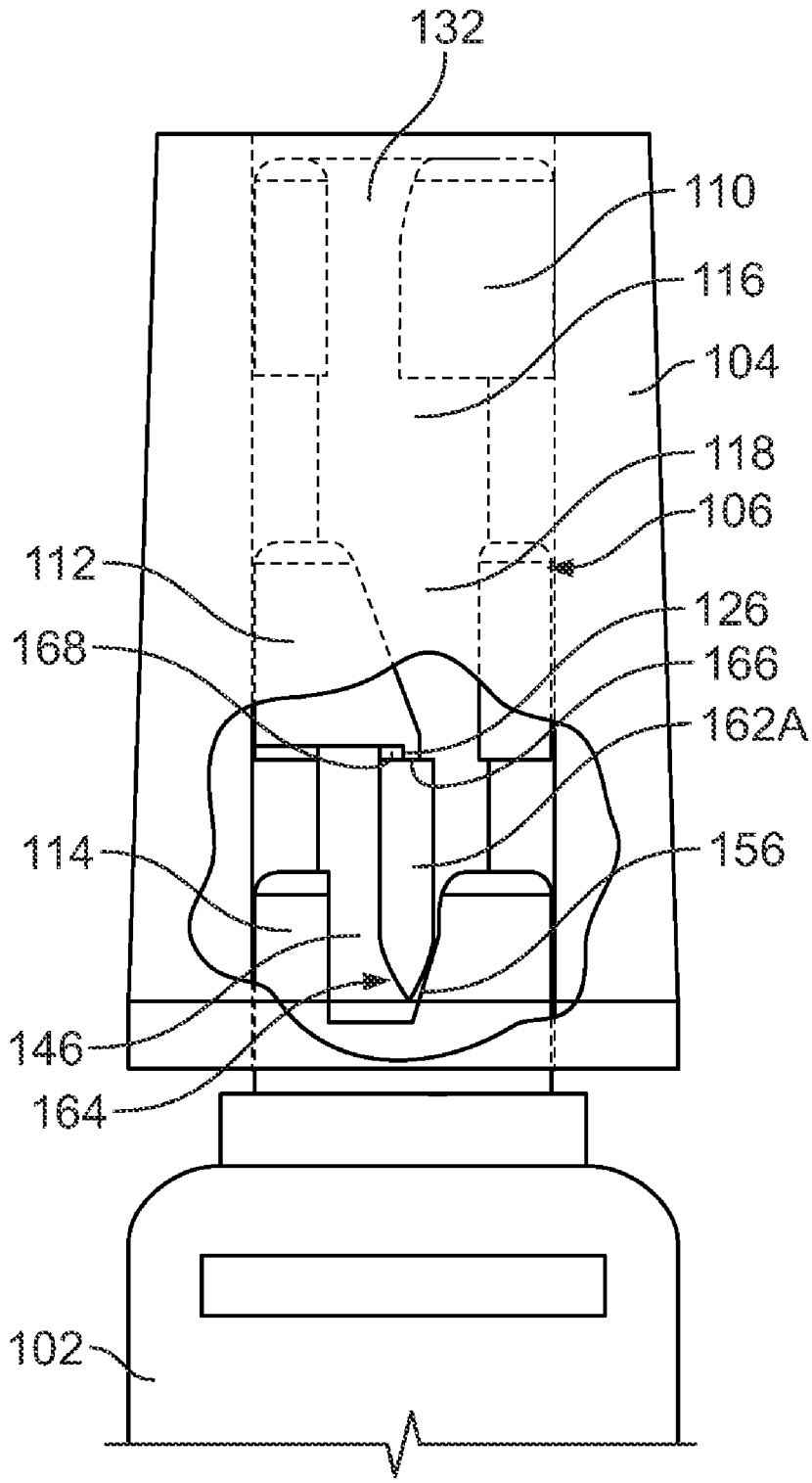
FIG. 10 is an elevation view of the shackle of the security seal of FIG. 7 in locking engagement with the shackle-receiving engagement housing.

Turning now to FIG. 10, the distal end of shackle 106 is shown locked into engagement housing 104. A portion of the shackle locked within the engagement housing is shown in this figure in broken lines since it lies below the surface of the housing. As is apparent from this figure, when the shackle was first inserted into the housing, pin 162A was aligned with straight undercut 132 (with pin 162B aligned with a like undercut on the opposite side of the shackle) and the undercut moved past the pin as the shackle was advanced into the engagement housing. As the undercut moved past the pin to locate the pin in the space FFF between annular locking member 110 and annular locking member 112, nose 164 of the pin met outer ramp wall 130 of undercut 118 causing the shackle to rotate as the ramp wall moved along the pin until the pin reached the proximal end of undercut 118. At this point, the advancing shackle caused pin 162A to emerge from undercut 118 and move through the space BBB between annular locking member 112 and annular locking member 114. The continuing movement of the shackle caused nose 164 of the pin to enter undercut 146 of proximal annular locking member 114 until ramped base wall 156 engaged the pin causing the shackle to resile or rotate in the opposite direction as the shackle moved further into the engagement member. As the proximal end 124 of annular locking member 112 cleared the pin, and pin base spur 168 also cleared spur 126 of annular member 112, with the rotation causing spurs 126 and 168 to interlock as shown, irreversibly fixing the shackle within the engagement housing. Thus any attempt to twist the engagement housing in order work the pin back through the undercuts will be prevented by engagement between spurs 126 and 168, any attempt to pull the shackle out of the engagement housing by brute force will be prevented by the engagement between the pin base 166 and the proximal end of locking member 112, and any effort to work a pick or any tool into the engagement housing will be prevented by entry locking member 110 and the offsets (and therefore absence of a clear line of sight) between undercuts 118, 132 and 146.

Figure 11:
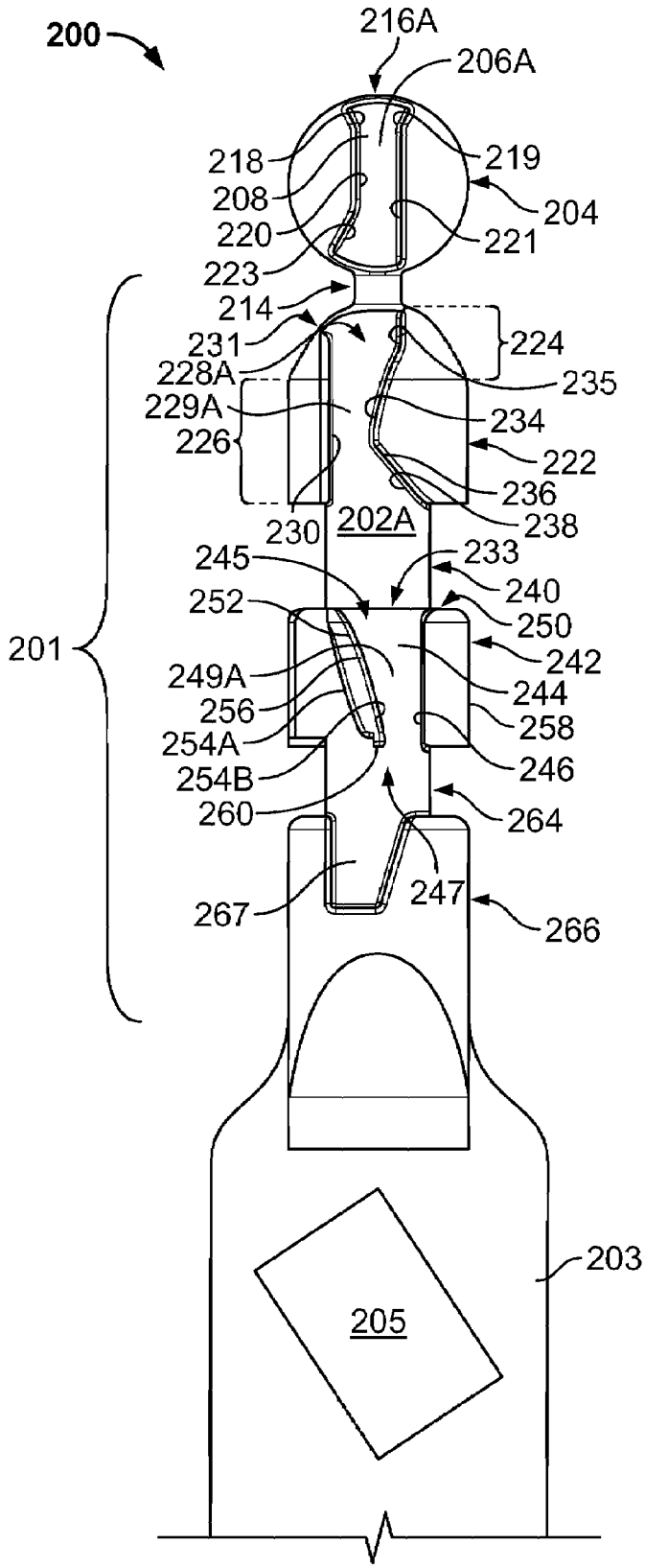
FIG. 11 is a partial elevation view of the distal end of the shackle of an alternative embodiment of the security seal of the invention that includes a frangible member located in a locking member undercut that will shear away if the locking mechanism of the security seal is breached.
Figure 12:
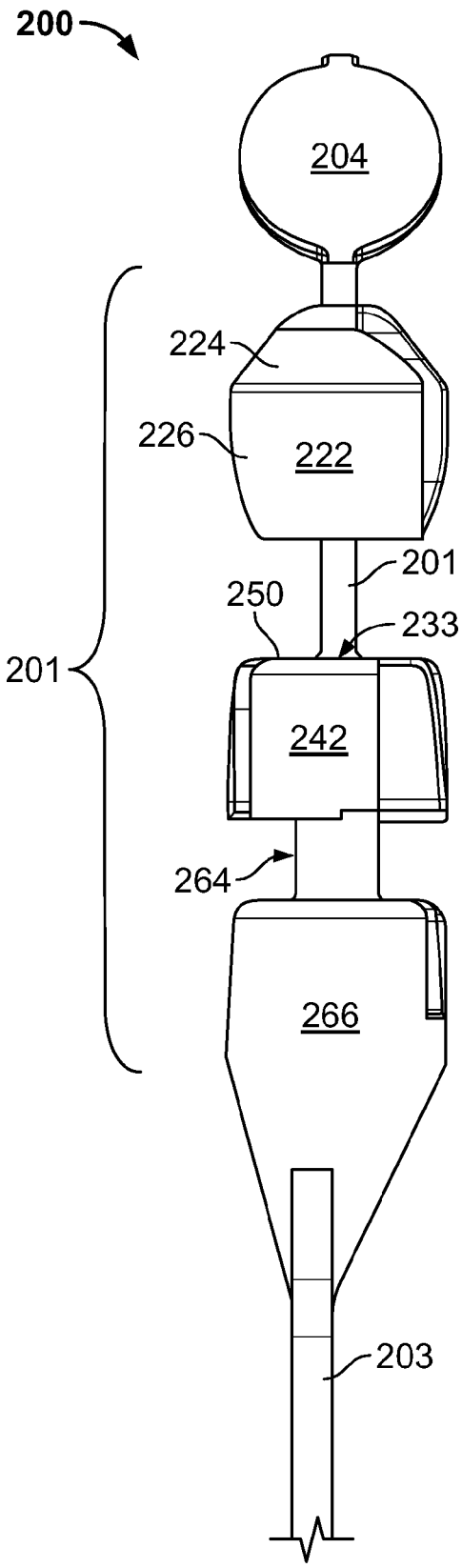
FIG. 12 is a partial perspective view of the distal end of the shackle of the embodiment of FIG. 11 in which the distal end of the shackle has been rotated 90° about its longitudinal axis.

FIGS. 11 and 12 are partial elevation views of the distal end of another embodiment of a unitized security seal 200 of the present invention that represents an improvement of the embodiment of FIGS. 7-10. The embodiment of FIGS. 11 and 12 includes three annular locking members 222, 242, and 266 and an optional distal plug 204, as will be discussed in greater detail below. Security seal 200 also includes a shackle portion 201 with flat faces 202A and 202B (not shown) on opposite sides of the shackle portion. Shackle portion 201 is joined to a flat strap 203 having an optional rectangular cut-out 205 to ensure breakage of the strap in the narrowed areas of the strap between the cut-out corners and the edges of the strap if undue force is applied to the strap. Even in the absence of a cut-out, it is preferred that the strap be designed (in terms of thickness, width, material, etc.) to break if undue force is applied.

Figure 13:
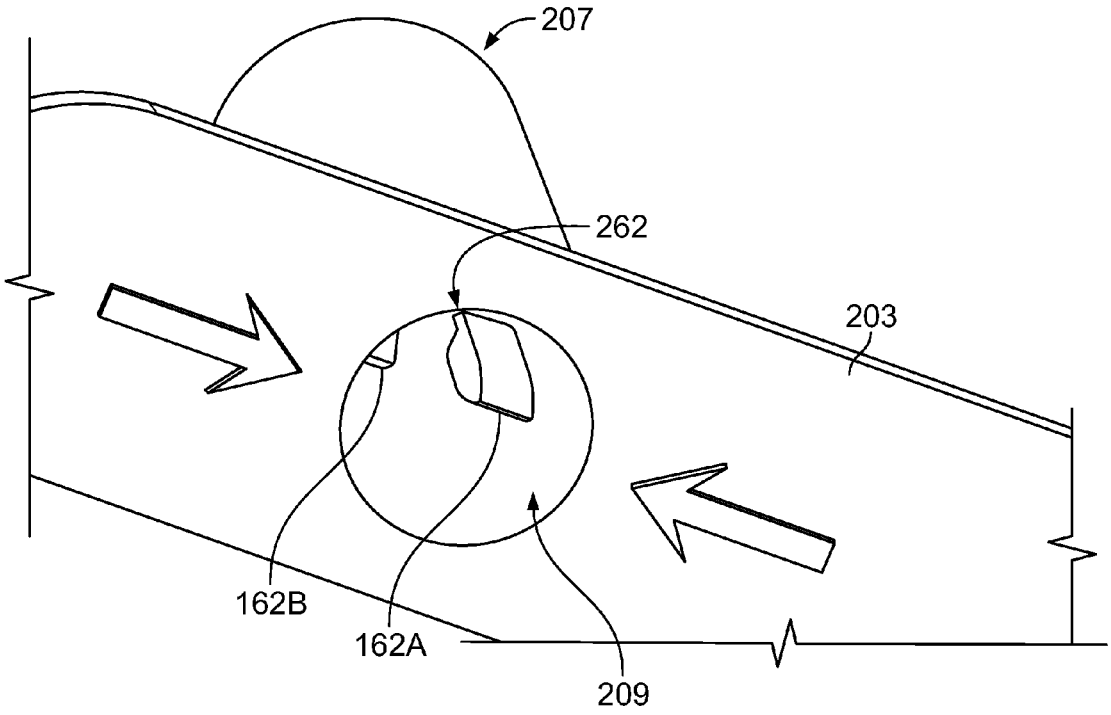
FIG. 13 is a partial perspective view of a proximal portion of a security seal in accordance with FIGS. 11 and 12, viewed from the bottom of the engagement housing.

Strap 203 extends beyond the edge of FIGS. 11 and 12 to the proximal end of the security seal which includes an engagement housing 207 like engagement housing 24 of the embodiment of FIGS. 1-6 or to engagement housing 104 of FIGS. 7-10. A partial bottom perspective view of engagement housing 207 with diametrically disposed pins 162A and 162B having spurs 262 at their base or trailing edge is shown in FIG. 13. As in the previously described embodiments of the invention, the security seal may also include a flag with surfaces like flag surfaces 26A and 26B of FIGS. 2-3.

Security seal 200 includes at its distal tip an optional spherical plug 204 with an engagement slot 206A that extends across the diameter of the spherical plug generally in alignment with the longitudinal axis of the shackle portion. Although the plug is spherical in the illustrated embodiment, it may be of other shapes so long as the top surface presents a generally dome-like surface to help thwart any attempt to gain purchase on the plug with a tool, as described below in connection with FIG. 14. A substantially identical engagement slot 206B (not shown) is positioned diametrically opposite to engagement slot 206A in the opposite surface of the spherical plug. The floors 208 of engagement slots 206A and 206B are generally flat and coplanar with respective flat faces 202A and 202B of the shackle portion 201. Although it is preferred that, as shown, spherical plug 204 be attached to the distal end of shackle portion 201 by a neck member 214, such a neck member need not be included. In a preferred embodiment, a neck member will be present and it will be a frangible link so that an attempt to circumvent the plug by forcing it aside will cause the plug to break away, providing an indication of tampering with the seal.

Engagement slot 206A (and its corresponding engagement slot 206B) includes optional entry bevels 218 and 219 at the entrance 216A to the engagement slot. Bevels 218 and 219 help direct pins 162A and 162B into the engagement slots as the distal end of the security seal is advanced within the engagement housing. The engagement slot has sides 220 and 221 and may include, as shown, an exit bevel 223 at the proximal end of the engagement slot to facilitate unobstructed movement of the distal end of the shackle past the pins in the engagement housing, as will also be explained in more detail below.

Moving proximally from spherical plug 204, the most distal locking member 222 on the shackle portion is next encountered. Locking member 222 has a rounded nose portion or dome 224 that transitions into a portion 226 that has a straight cylindrical outer profile. The other locking members have substantially the same outer profile. The outer profile of cylindrical portion 226 (and the cylindrical portions of the other locking members) is preferably dimensioned so that it achieves a tight but slideable fit within the bore 209 of the engagement housing. A portion of the surface of the first locking member is formed as shown into an undercut 228A having a floor 229A. In a preferred embodiment of the invention, floor 229A will be coplanar with the flat face 202A of the shackle to provide clearance for the locking housing pins but then will thicken to form a step 233 at the entry 245 to the locking member to ensure proper engagement between pin 162A and barrier wall 252, as will be described in detail below. An identical undercut 228B and step is located on the underside of the locking member generally diametrically opposed to undercut 228A.

The undercuts in locking member 222 have a first generally flat wall 230 that is generally parallel to the longitudinal axis of the shackle portion but may have a radiused corner 231 at the distal end of the undercut. It is also preferred that flat wall 230 be aligned with the widest corresponding proximal point of slot 206A which, in the illustrated embodiment, corresponds to the proximal end of bevel 220. A second wall 234 of undercut 228A which is generally opposite flat wall 230 is, as shown, irregular in shape, in order to act as a funnel in facilitating the resiling movement of the distal end of the shackle past the engagement pin(s) within the engagement housing as the seal is closed and secured. Second wall 234 has an entry portion 235 that is aligned with wall 221 of engagement slot 206A. Wall 234 tapers gently inwardly (toward flat wall 230) until transition point 236 where wall 234 transitions into an outwardly beveled section 238 to ensure proper clearance as the shackle moves past the pin(s) in the engagement housing.

Continuing toward the proximal end of the security seal, a spacing 240 (corresponding to spacing FFF in FIG. 8) is next encountered followed by an intermediate annular locking member 242. The intermediate locking member includes an undercut 244 with an entry 245 and an exit 247 along the longitudinal axis of the shackle portion. Undercut 244 has a floor 249. Undercut 244 extends from a first flat wall 246 that is generally parallel to the longitudinal axis of the shackle portion and is aligned generally with the widest corresponding proximal portion of undercut 228A. Additionally, it is preferred that the distal end of second annular locking member 242 be radiused as shown at 250.

Intermediate undercut 244 includes a frangible member in the form of an upstanding frangible barrier wall 252 that is integral with and formed from the same material as that of the rest of the security seal. Frangible barrier wall 252 has opposite sides 254A and 254B and its top edge is shaped to correspond to the outer profile 258 of annular locking member 242 so that it can pass through the engagement housing without interference with the edges of the passage. Preferably side 254B will be slightly curved to help funnel the undercut past the pin. A proximally directed spur 260 is located at the proximal edge of barrier wall 252.

The upstanding barrier wall preferably ramps down from the entry of the undercut at an angle of about 10° to 20° to the longitudinal axis of the shackle to form a narrowed passage at the exit of the undercut. Still more preferably, the barrier wall ramps down from the entry of the undercut at an angle of about 15° to the longitudinal axis of the shackle. Also, pins 162A and 162B preferably are of a predetermined width that is substantially equal to the width of the narrowed passage.

In the operation of security seal 200, surface 254B of frangible wall 252 corresponds generally to outer ramp wall 130 of undercut 118 of the embodiment of the invention depicted in FIG. 8 with wall spur 260 corresponding with spur 126 in the earlier embodiment. Thus wall spur 260 interlocks with pin base spur 262 (FIG. 13), irreversibly fixing the shackle in the engagement housing as discussed previously with respect to the security seal embodiment of FIGS. 7-10. If sufficient force is applied to a locked or engaged shackle to remove it from the engagement housing, however, frangible wall 252 will shear away from undercut 244 as illustrated below in FIGS. 16A-16F. In a less preferred circumstance, the wall will at least bend out of the way and remain in a sufficiently bent condition to prevent reinsertion and relocking of the seal. Then, should the security seal be again closed by pushing the shackle member back through the engagement housing, it will not lock due to the absence (or bent non-engaging condition) of the frangible wall. This provides an indication that the security seal has been breached.

In order to ensure that the frangible barrier member shears off as desired in the event that the shackle is forced from the engagement housing, it is preferred that the material of the unitized security seal have the appropriate tensile and elongation-to-break characteristics. For example, materials with a flexural modulus of at least about 300,000 psi and an elongation-to-break of about 50% to 80% and preferably about 75% at 73° are currently preferred. One material that may be used in making the seal is a polyacetal sold by DuPont under the trademark Delrin 500T.

Continuing in a proximal direction, belt spacing 264 is next encountered followed by a proximal locking member 266 with undercut 267 like undercut 118 of the embodiment of FIGS. 8-10. Preferably, pins 162A and 162B have a predetermined length and spacing 264 between the intermediate and proximal locking members is less than the predetermined length of the pins.

Thus, the engagement process for this embodiment of the invention generally parallels that described above with respect to the embodiment of FIGS. 7-10, with side 254B of frangible barrier wall 252 acting in the same fashion as outer ramp wall 130 of undercut 118 causing the shackle to resile as wall 252 moves along the pin, as explained in more detail above with regard to outer ramp wall 130.

Figure 14:
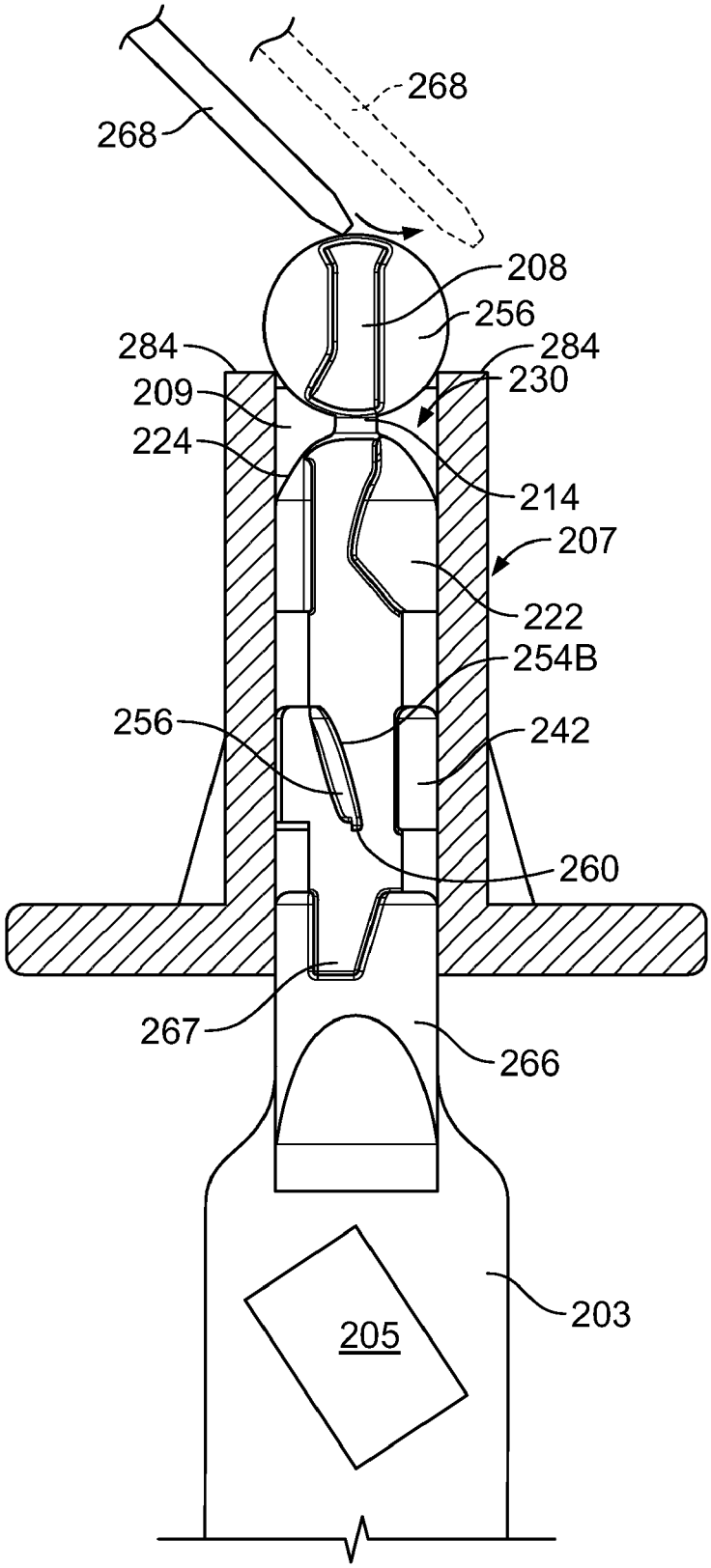
FIG. 14 is a partial elevation view of the distal end of the shackle of FIGS. 11 and 12 positioned within the cut-away engagement housing of the device (sans the housing pins), illustrating an unsuccessful attempt to force the shackle from the housing.

Turning now to FIG. 14, an elevation view of the distal end of the shackle of the security seal of FIGS. 11 and 12 is shown positioned within engagement housing 207 of the security seal (sans pins 162A and 162B), with housing 207 cut away to show the distal end of the shackle portion. As can be seen in this figure, domed nose portion 256 inhibits entry to bore 209 of the engagement housing. Although the domed nose portion is shown in this figure as being located adjacent to the top edge 284 of the engagement housing, if the nose portion is spaced from the top edge it nevertheless will help thwart any attempt to force the shackle back out of the engagement housing. This is because first the domed nose portion makes it extremely difficult if not impossible to pass a tool into the bore 209 of the engagement housing passage to work the shackle out of the housing. Second, the rounded exposed surface of the rounded nose portion makes it extremely difficult to gain purchase with a tool like screw driver 268 to force the shackle back out from the bore of the engagement housing. Thus, screw driver 264 is shown glancing off of the surface of the rounded nose portion in this figure, thereby thwarting an attempting to force the shackle back out of the engagement housing. Also, the seal may be configured so that dome 224 of locking member 222 protrudes from the housing with the dome surface of the locking member making it difficult to gain purchase with a tool, even if nose portion 256 is absent.

Furthermore, even if it were possible to force the shackle back out of the bore of the engagement housing, this would destroy the locking feature of the security seal as explained below with respect to FIGS. 16A-16F. Where the security seal is used in order to indicate that a sealed container or other item has not been tampered with, this ensures that a breached seal cannot be fraudulently reused.

Figure 15:
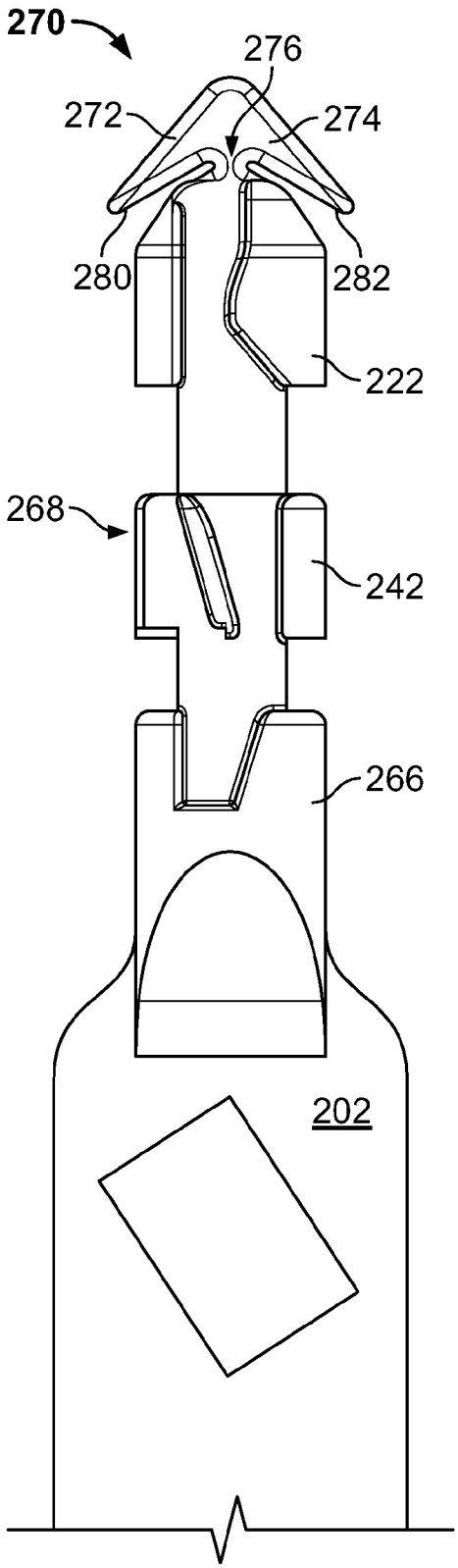
FIG. 15 is a partial perspective view of the distal end of an alternative embodiment of the security seal of the invention that includes a second frangible member including resilient wings that compress when entering the passage in the engagement housing and return to their original shape when emerging.

FIG. 15 illustrates an alternative security seal embodiment of the invention depicted in FIGS. 11 and 12 in which domed nose portion 256 has been replaced by an arrow member 270 having resilient wings 272 and 274 that project beyond the outer profile 268 of annular locking members 222, 242 and 266. Arrow member 270 is joined to the distal end of shackle portion 201 by a frangible link 276.

Thus, when the distal end of a security seal in accordance with the present invention is pushed into the passage in the engagement housing, wings 272 and 274 of arrow 270 are compressed inwardly and emerge from the bottom of the passage, returning generally to their original shape so that the undersides 280 and 282 of the wings engage the top edge 284 (FIG. 14) of the engagement housing. If it is attempted to force the shackle back out of the engagement housing, the undersides of the wings will hook onto the top edge of the engagement housing and when the failure point of frangible link 276 is reached, the frangible link will break away. If the shackle is then re-inserted in the engagement housing the arrow member will of course be missing, providing a visual indication that the security seal has been tampered with.

Figure 16A:
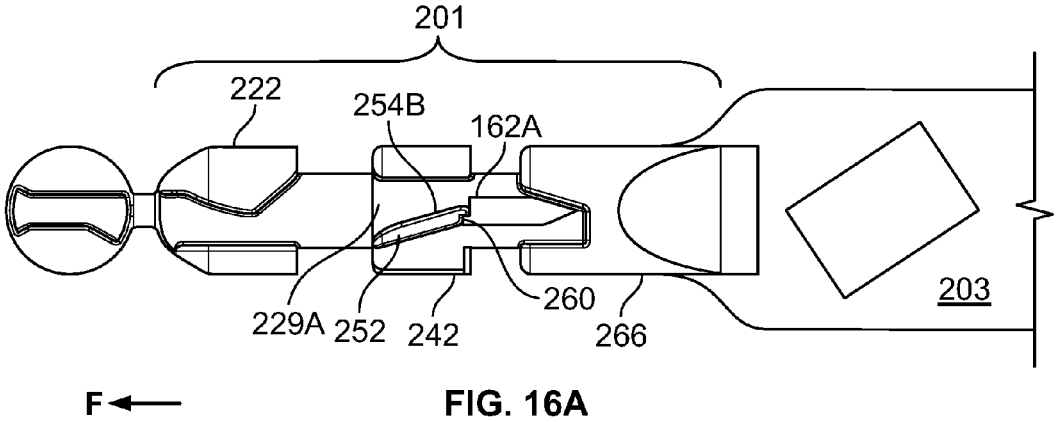
FIGS. 16A-16F are partial views of the distal end of the security seal of FIGS. 11 and 12 showing the shearing of the frangible member as the shackle is forced from the engagement housing of the security seal.
Figure 16B:
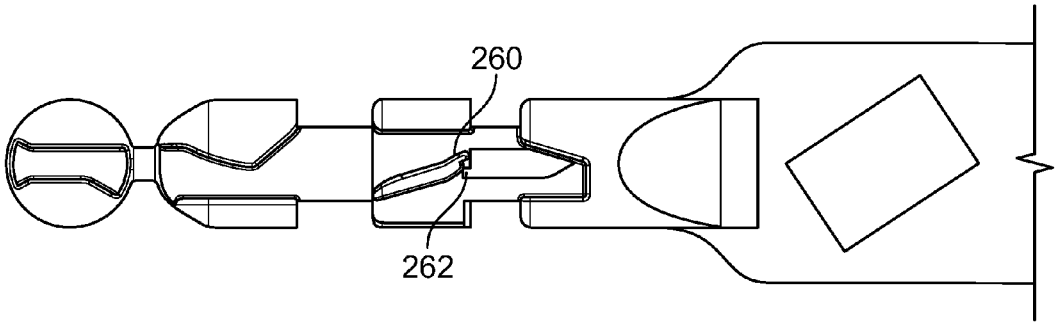
Figure 16C:
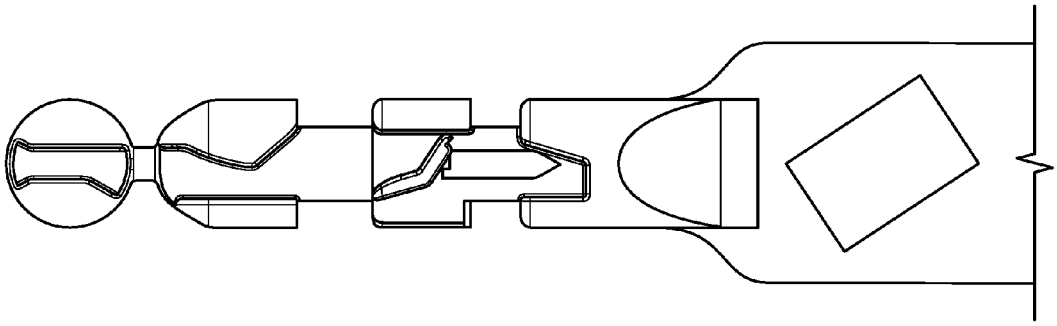
Figure 16D:
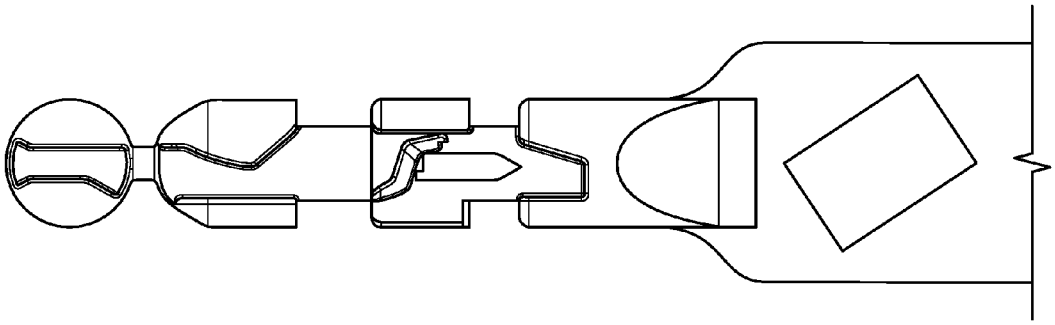
Figure 16E:
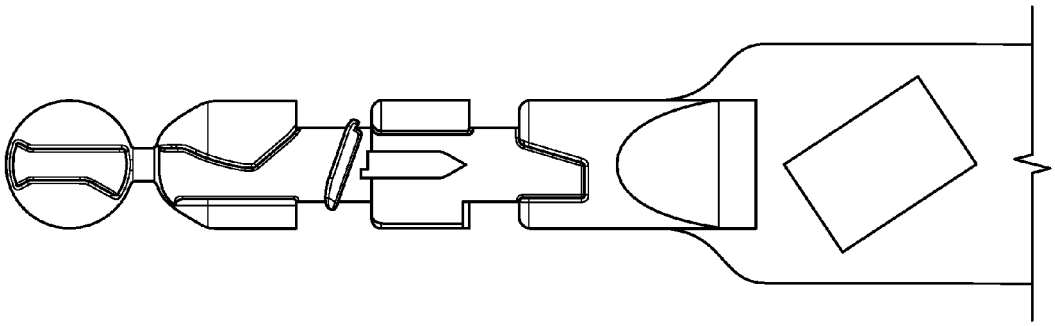
Figure 16F:
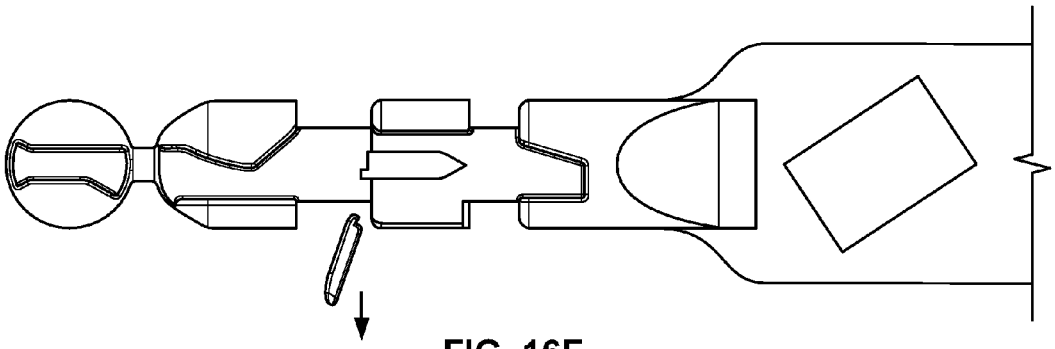

Turning now to FIG. 16A, an engaged shackle portion 201 is shown with most of the engagement housing removed and spur 262 of pin 162A interlocked with spur 260 of frangible barrier wall 252 of the housing. If force is now applied to the distal end of the shackle in direction "F", frangible barrier wall 252 will begin to be torn away from floor 224A of undercut 228A continuing as shown in FIGS. 16B through 16E until the frangible member is broken away from the undercut floor and falls away as shown in FIG. 16F. With the frangible member gone, the locking function of the security seal is destroyed indicating that the seal has been tampered with. Should the seal be reattached, the breach can be readily reconfirmed by simply applying a light pressure in direction "F" to remove the shackle from the housing confirming the absence of the locking function supplied by the frangible barrier wall.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. It should be understood that the illustrated embodiments are exemplary only, and should not be taken as limiting the scope of the invention.

What is claimed is:

1. A unitized security seal comprising:

a shackle;

an engagement housing with a passage for receiving the shackle;

at least distal, intermediate and proximal members spaced along the shackle, the members each having at least one undercut extending from the surface of each member to an undercut floor, the undercuts of the distal and intermediate members having an entry and an exit generally along the longitudinal axis of the shackle and the undercut of the proximal member having an entry generally along the longitudinal axis of the shackle;

at least one pin located within the engagement housing passage oriented to extend into the undercuts when the distal and intermediate members on the shackle pass through the passage; and the undercut of the intermediate member including a frangible member positioned between its entry and its exit for engaging the pin to resist removal of the shackle from the engagement housing until a sufficient force is applied to shear away the frangible member.

2. The unitized security seal of claim 1 in which the frangible member is an upstanding wall projecting away from the floor of the undercut of the intermediate member.

3. The unitized security seal of claim 2 in which the upstanding wall ramps down from the entry of the undercut at an angle of about 10° to 20° to the longitudinal axis of the shackle to form a narrowed passage at the exit of the undercut.

4. The unitized security seal of claim 3 in which the pin has a predetermined width that is substantially equal to the width of the narrowed passage.

5. The unitized security seal of claim 2 in which the upstanding wall has a proximal edge, the pin has a trailing edge, and the proximal edge of the wall engages the trailing edge of the pin to resist removal of the shackle from the engagement housing until a sufficient force is applied to shear away the frangible member.

6. The unitized security seal of claim 5 in which a wall spur is located at the proximal edge of the upstanding wall and a base spur is located at the trailing edge of the pin and the wall spur interlocks with the pin base spur to resist rotation and removal of the shackle from the engagement housing.

7. The unitized security seal of claim 1 in which the pin has a predetermined length along the longitudinal axis of the shackle and the spacing between the members is less than the predetermined length of the pin.

8. The unitized security seal of claim 1 in which the undercuts of the members are offset from each other.

9. The unitized security seal of claim 1 in which each member has a pair of generally diametrically opposed undercuts and at least a pair of opposed pins are located within the engagement housing passage and oriented to engage the diametrically opposed undercuts.

10. The unitized security seal of claim 9 in which the shackle has a central member with at least two opposite generally flat faces that each form a step up at the entry to the intermediate member undercut.

11. The unitized security seal of claim 1 in which the frangible member will either shear away or bend out of the way when a sufficient force is applied in an attempt to remove the shackle from the engagement housing.

12. The unitized security seal of claim 1 including at least one labeling or serializing surface.

13. A unitized security seal comprising:

a shackle;

an engagement housing with a passage for receiving the shackle;

at least distal, intermediate and proximal members spaced from each other along the shackle, the members each having at least one undercut extending from the surface of the locking member to an undercut floor, the undercuts of the distal and intermediate members each having an entry and an exit generally along the longitudinal axis of the shackle;

at least one pin located within the engagement housing passage with a nose portion oriented to extend into the undercuts of the distal and intermediate members when the shackle is passed through the passage, with the undercut of the intermediate member including an upstanding frangible wall extending between the entry and exit of the intermediate member at an angle of about 10° to 20° to the longitudinal axis of the shackle to form a narrowed passage at the exit of the undercut, the frangible member being positioned to guide the shackle past the pin as the shackle is advanced into the engagement housing and to resist removal of the shackle from the engagement housing until a sufficient force is applied to shear away the frangible member.

14. The unitized security seal of claim 13 in which the upstanding frangible wall ramps down from the entry of the undercut at an angle of about 15° to the longitudinal axis of the shackle to form a narrowed passage at the exit of the undercut.

15. The unitized security seal of claim 13 in which the upstanding frangible wall has a proximal edge with a wall spur, the pin has a trailing edge with a base spur and the wall spur interlocks with the pin base spur to resist removal of the shackle from the engagement housing.

16. The unitized security seal of claim 13 in which the pin has a predetermined length along the longitudinal axis of the shackle and the spacing between the locking members is less than the predetermined length of the pin.

17. A unitized security seal comprising:

a shackle;

an engagement housing with a passage for receiving the shackle;

proximal, intermediate and distal members spaced along the shackle, a plug at the distal end of the shackle dimensioned to inhibit access to the engagement housing passage, the plug having an engagement slot with a floor that extends across the plug generally in alignment with the longitudinal axis of the shackle, each of the members having at least one undercut opening in the member outer surface extending to an undercut floor, and the corresponding floors of the members in communication with each other and with the engagement slot of the plug, the undercuts of adjacent members being offset from each other;

at least one pin located within the engagement housing passage oriented to engage the engagement slot of the plug and the undercuts of the locking members when the shackle moves within the passage; and in which the intermediate member undercut includes a frangible member for engaging the pin to resist removal of the shackle from the engagement housing until a sufficient force is applied to shear away the frangible member or to bend it out of the way of the pin.

18. The unitized security seal of claim 17 including a frangible link connecting the plug to the shackle.

19. The unitized security seal of claim 17 in which the engagement slot includes an entry bevel at the entrance to the engagement slot to help direct the pin into the engagement slot as the distal end of the security seal is advanced within the engagement housing.

20. The unitized security seal of claim 17 in which the members each have a second undercut opening generally diametrically opposed from the first undercut opening and the plug has a generally rounded top surface and a second engagement slot generally diametrically opposed from the first engagement slot in the plug.

21. The unitized security seal of claim 17 in which the bottom surfaces of the undercuts are generally flat and there is a step up at the entry to the intermediate member undercut.

22. The unitized security seal of claim 17 in which the plug has a spherical surface.

23. A unitized security seal comprising:

a shackle;

an engagement housing with a cylindrical passage for receiving the shackle;

proximal, intermediate and distal members spaced along the shackle, the members having a cylindrical outer profile, the members each having at least one undercut extending from the cylindrical outer surface of the member to an undercut floor, the cylindrical outer profile being dimensioned to achieve a tight slideable fit within the cylindrical passage of the engagement housing, the distal and intermediate members having entries and exits generally along the longitudinal axis of the shackle;

at least one pin located within the engagement housing passage with a nose portion oriented to engage the undercuts when the distal and intermediate members are passed through the passage; and the undercut of the intermediate member including a frangible wall extending between its entry and exit openings at an angle of about 10° to 20° to the longitudinal axis of the shackle to form a narrowed passage at the exit of the undercut, the frangible wall being positioned to guide the shackle past the pin as the shackle is advanced into the engagement housing and to resist removal of the shackle from the engagement housing until a sufficient force is applied to shear away the frangible member or to bend it out of the way of the pin.

24. A unitized security seal comprising:

a shackle;

an engagement housing with a cylindrical passage for receiving the shackle;

proximal, intermediate and distal members spaced along the shackle, the members having a cylindrical outer profile, the members each having at least one undercut extending from the cylindrical outer surface of the member to an undercut floor, the cylindrical outer profile being dimensioned to achieve a tight slideable fit within the cylindrical passage of the engagement housing, the undercuts in the distal and intermediate members having entries and exits generally along the longitudinal axis of the shackle;

at least one pin located within the engagement housing passage oriented to extend into the undercuts when the distal and intermediate members on the shackle are passed through the passage;

the undercut in the intermediate member including a frangible member in the form of an upstanding wall projecting away from the floor of the undercut, positioned between its entry and its exit for engaging the pin, the upstanding wall having a proximal edge, the pin having a trailing edge, and the proximal edge of the wall engaging the trailing edge of the pin to resist removal of the shackle from the engagement housing until a sufficient force is applied to shear away the frangible member or bend it out of the way of the pin; and a wall spur located at the proximal edge of the wall and a base spur located at the trailing edge of the pin, the wall spur and the base spur being positioned to interlock to resist rotation and removal of the shackle from the engagement housing.

* * * * *